United States Patent [19]

Nagode

[11] 4,231,210

[45] Nov. 4, 1980

[54] PACKAGE WRAPPING MACHINE

[76] Inventor: Gerald E. Nagode, 17920 S.W. Frances, Aloha, Oreg. 97005

[21] Appl. No.: 32,939

[22] Filed: Apr. 24, 1979

[51] Int. Cl.[3] ..... B65B 11/08; B65B 27/10

[52] U.S. Cl. ..... 53/397; 53/416; 53/450; 53/138 R; 53/209; 53/547; 53/580; 83/178; 227/110

[58] Field of Search ..... 53/397, 416, 450, 466, 53/137, 138 R, 209, 173, 547, 550, 580, 590

[56] References Cited

U.S. PATENT DOCUMENTS

| | | | |
|---|---|---|---|
| 1,596,514 | 8/1926 | Anderson | 53/397 |
| 1,946,056 | 2/1934 | Birdsey | 53/580 X |
| 1,978,035 | 10/1934 | Thom | 53/137 X |
| 3,052,072 | 9/1962 | Keely | 53/137 X |
| 3,405,501 | 10/1968 | Edelberg | 53/550 X |
| 4,183,193 | 1/1980 | Klingelhofer | 53/450 |

FOREIGN PATENT DOCUMENTS

| | | | |
|---|---|---|---|
| 2735889 | 2/1979 | Fed. Rep. of Germany | 53/550 |

*Primary Examiner*—John Sipos

*Attorney, Agent, or Firm*—Clarence A. O'Brien; Harvey B. Jacobson

[57] ABSTRACT

The machine includes a roll case for positioning and conveying a package to be wrapped into position. In the first position, paper is folded along the front of the package and stapled. The package is then conveyed to a second position during which time the paper is dispensed onto the top and two sides of the package and stapled along the sides. After the package comes to rest in its second position, the paper is cut, folded and stapled along the back side of the package to produce a package which is neatly wrapped with paper on its top and four sides.

24 Claims, 20 Drawing Figures

3
3
100
102
104
106
106
106
108
110
112
116
117
118
118
119
119
121
122
124
128
130
134
136
138
140
142
146
148
150
152
154
156
158
164
198
224
232
234
P
P'

Fig. 7
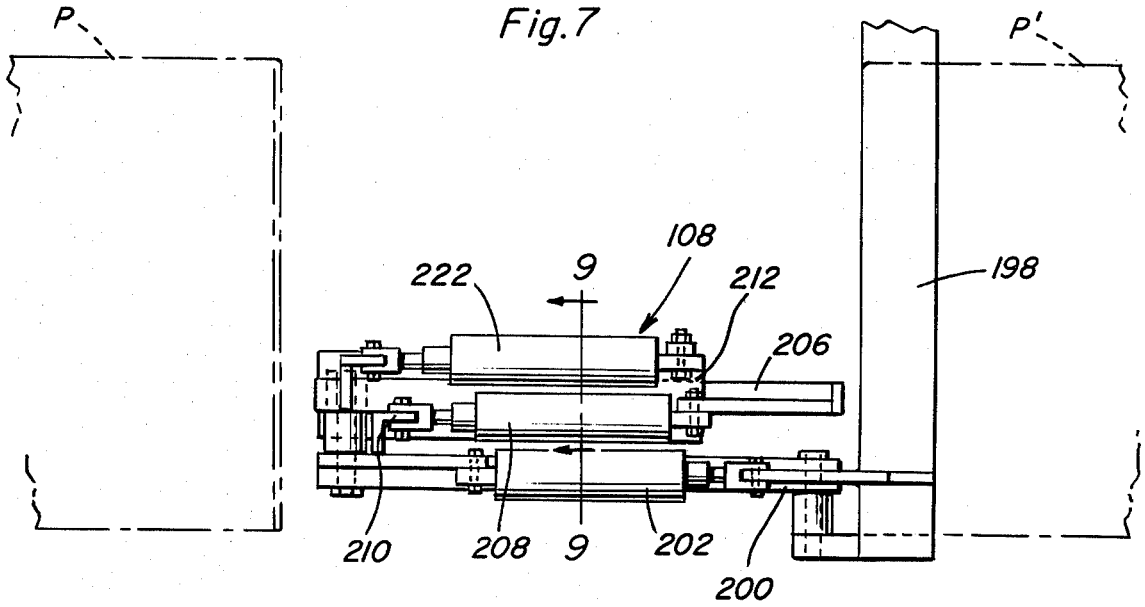
Fig. 8
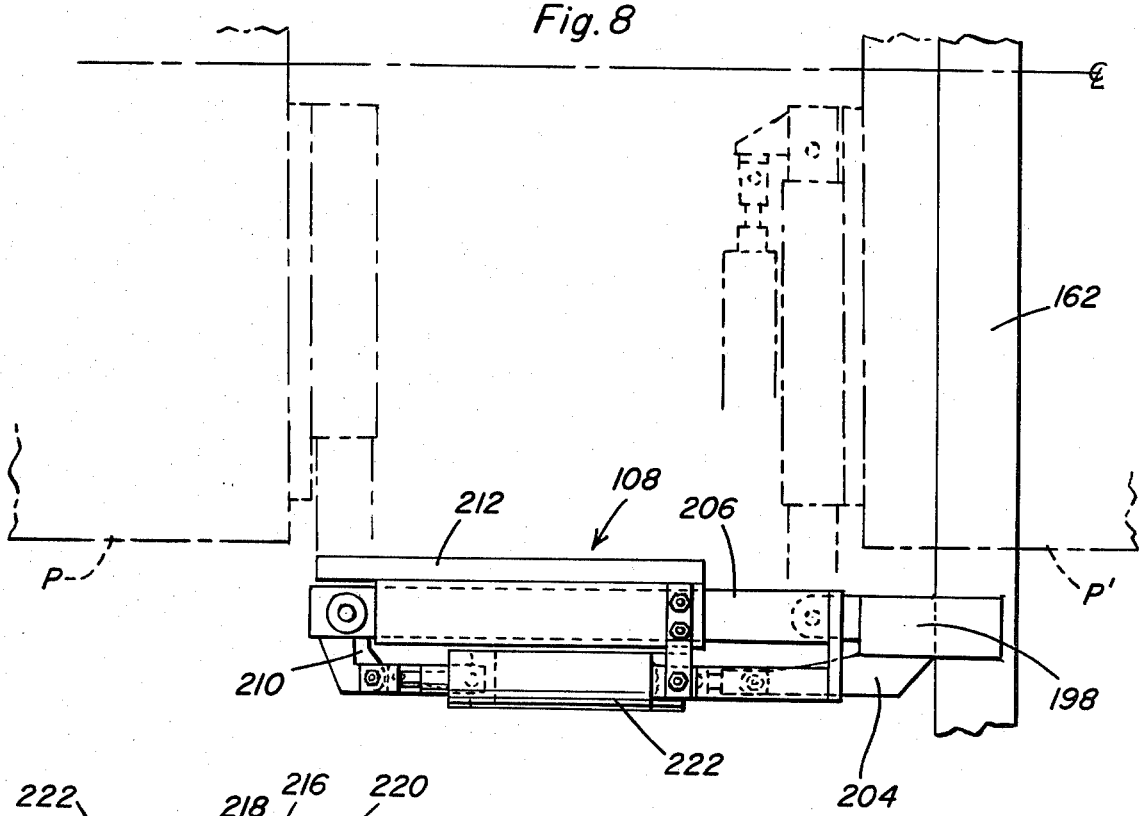
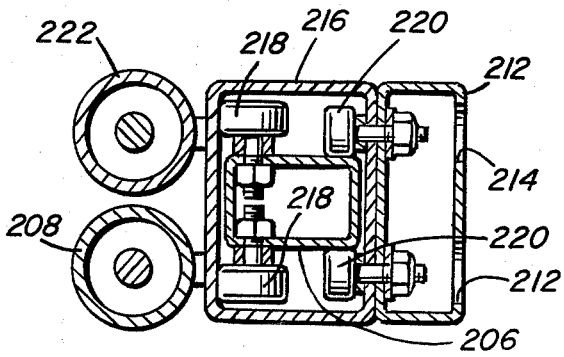
Fig. 9

240
242'
242
245
12
244
242"
260
246
238
268
13
256
112
11
11
248
232
228
228
224
254
230
12
13

245
242
P 244
256
246
298
238
260
294
260
296
268
266
308
300
262
310
258
260
264
276
274

245
248
236
256
112
228
226
258
238
260
228
224
228
230
240
252
260
264
293
250
246
268

PACKAGE WRAPPING MACHINE

BACKGROUND OF THE INVENTION

1. Field of the Invention

This invention relates to package wrapping machines and especially to such machines adapted for use in wrapping lumber which has previously been banded together 2. Description of the Prior Art The industry standard for lumber packages is two feet high by four feet wide. These packages may vary in length and may be, for example, 8 feet long, 10 feet long, 20 feet long, 28 feet long, or longer. Each package contains a plurality of individual lumber products which may themselves vary in length, but are held together in a unitary bundle by straps which are attached around the periphery of the package in a previous operation. In order to protect the lumber package from the elements, it is necessary to apply a layer of plastic film or paper over the package, leaving the bottom open for air circulation in order to inhibit lumber mildew or fungus growth.

The prior art consists mainly of a manual operation wherein sheeting is applied to the top and four upstanding sides of the lumber package. The industry practice is to use staples which actually enter the products being packaged for holding the wrapping material to the product.

A number of automated package wrapping machines are also known in the prior art. Included among these are:

U.S. Pat. Nos.

545,397—Aug. 27, 1895
2,215,544—Sept. 24, 1940
2,671,998—Mar. 16, 1954
2,737,002—Mar. 6, 1956
3,153,300—Oct. 20, 1964
3,307,326—Mar. 7, 1967
3,429,098—Feb. 25, 1969
3,486,294—Dec. 30, 1969
3,685,253—Aug. 22, 1972
3,750,361—Aug. 7, 1973
3,832,822—Sep. 3, 1974
3,986,319—Oct. 19, 1976
4,077,179—Mar. 7, 1978.

These automated prior art systems are relatively complex and are generally adapted for wrapping articles having fixed predetermined dimensions. None of these prior art devices has been found to be readily adaptable for use in packaging lumber products having various lengths.

SUMMARY OF THE INVENTION

The present invention provides a machine and process for wrapping the top and four upstanding sides of lumber packages having a fixed lateral dimension but various lengths. The package is positioned upon a roll case which conveys the package into a first position on the machine. An overhead paper storage roller feeds wrapping material around a pair of brush rollers which rest on the top of the package to be wrapped. A pair of side brush rollers push the wrapping material against the sides of the package and the material extends forwardly of the package whereat it is held by a left and right fold frame by a vacuum means. A center top fold frame holds the top of the wrapping material in a similar manner. The left and right fold frames pivot against the leading edge of the package and a pair of staplers move laterally across the package stapling the wrapping material thereto. The fold frames return to their initial positions and the package is moved forwardly on the roll cage pulling wrapping material from the storage roll as it moves. The staplers are pivoted 90° and staple the material along the sides of the package as it passes by. The package is stopped in a second position on the roll case at which time the vacuum in the fold frame is reinitiated to hold the material thereagainst. A slitter mechanism rises, cuts the wrapping material and holds the cut edge to itself by a set of vacuum holes. Each of the fold frames is then capable of pivoting on a second axis so as to fold the material against the trailing edge of the package. The side fold frames fold first with the staplers pivoting to face the rear of the package to provide a row of staples similar to that inserted in the package leading edge. The side fold frames return to their initial position and the center fold frame brings the final flap down to be stapled against the package. The center fold frame returns to its initial position and the slitter moves forwardly to insert the supply of paper held by it into the fold frames. The slitter then moves to its initial position at which time the leading edge of a second package may be wrapped in a similar manner.

Accordingly, one object of the present invention is to provide a package wrapping machine which is adapted to wrap five sides of a six-sided package, leaving the bottom of the package open to allow air to circulate and reduce lumber mildew or fungus growth.

A further object of the present invention is to provide a package wrapping machine which uses wrapping material from a continuous roll which has one width but is not limited in length, thereby enabling the wrapping of packages having a fixed width but varying lengths.

Yet a still further object of the present invention is to provide a package wrapping machine wherein the wrapping material is held directly to the product by the use of staples which actually enter the product being packaged.

An additional object of the present invention is to provide a package wrapping machine which includes a folding apparatus which can be used to fold the wrapping paper to cover the leading edge or the trailing edge of the package.

Yet one still further object of the present invention is to provide a package wrapping machine having at least two work positions for the package wherein a portion of the procedure is effected while the package is being moved from one position to the next.

One even further object of the present invention is to provide a package wrapping machine including a slitter mechanism for cutting the wrapping material wherein the slitter cuts the material while it is held in inverted U-shaped configuration.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 7 is a side elevational view showing the right ide fold frame of the package wrapping machine.

FIG. 8 is a top plan view of the right side fold frame howing the fold frame positioning for engaging a packge leading edge and a package trailing edge.

FIG. 9 is an end sectional view of the right side fold rame taken along a plane passing substantially through ection line 9—9 of FIG. 7 showing the slide mechaıism.

DESCRIPTION OF THE PREFERRED EMBODIMENTS

Figure 1:
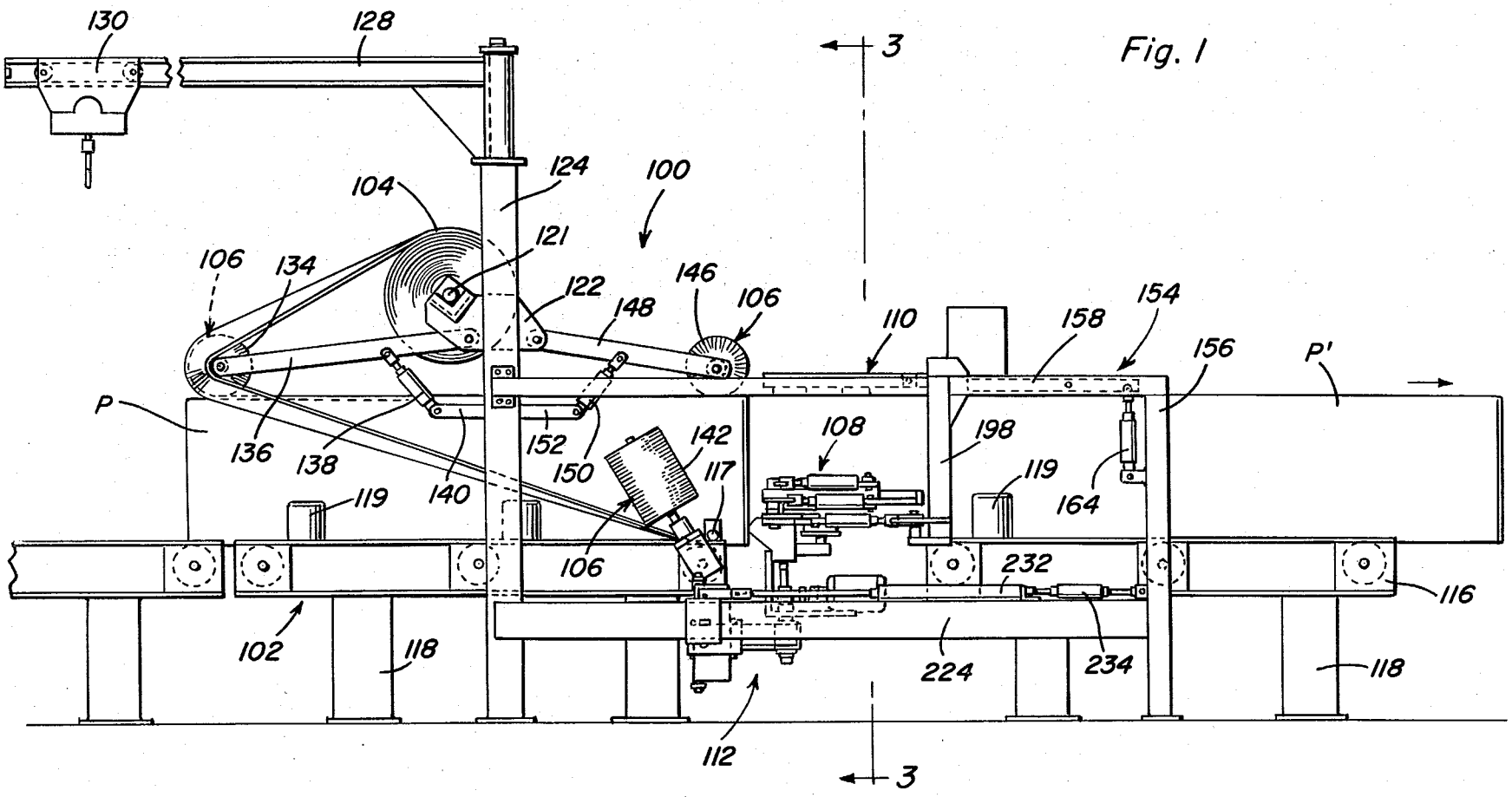
FIG. 1 is a side elevational view of the package wrapping machine.

Now with reference to the drawings, the package vrapping machine, generally referred to by the numeral 00 will be described in detail. Especially with refernce to FIGS. 1 through 3, it can be seen that the packge wrapping machine consists of seven basic sections. ection 102 is the roll case which extends for the entire ongitudinal dimension of the machine and positions and onveys a package into position P. An overhead paper torage roll 104 provides a continuous length of wrapping material which can be weather-resistant paper, polyethylene, or any other suitable wrapping film. The wrapping material is supplied from the roll to the third section, comprising two holddown brush rollers and two side brush rollers, generally referred to by the numeral 106. A pair of side fold frames 108 are positioned on either side of the machine between the position of package P and the position designated by P'. Further, a center fold frame 110 is positioned between and vertically above the side fold frames 108. The sixth section of the machine consists of left and right stapler systems 112 which serve to attach the wrapping material W to the four upstanding sides of the package. The last section of the machine is the sheet slitter 114 which cuts wrapping material W between position P and P'.

The roll case 102 consists of a pair of spaced, longitudinally extending channel bars 116 which are attached to and supported by a plurality of upstanding legs 118. A plurality of rollers 120 extend between and are supported and journaled by bearing mounted on the channel bars 116. The rollers 120 are actuated by electric motors, pneumatic motors, or the like. The operation of these motors is controlled by limit switches which are positioned on the machine. The roll case is operative to move the package to the position P where the initial wrapping procedures are carried out. A limit switch is located on one of the side rails 116 to sense the leading edge of a package to be stopped in this position. After the initial wrapping procedures are carried out, the package is moved forward on the roll case to position P'. During all the movement of the package, side motion is inhibited by the use of package guide dead rollers 119 which are attached to the channel bars 116 and are spaced so as to contact the sides of package. Also attached to the channel bars are rubber faced clamps 117 the function of which will be discussed hereinafter.

Paper roll 104 includes wrapping material W which is disposed on paper roll core shaft 121. Shaft 121 is supported at its ends by cradles 122 which are individually attached to upstanding pillars 124 and 126. Riding above pillar 124 is a roll handling jib boom 128 which is pivotally mounted within the pillar. Mounted on the boom 128 is a trolley hoist 130 which can move laterally along the boom. When it is necessary to change paper storage roll 104, the boom 128 is connected to a roll handling spreader bar 132, shown in phantom in FIG. 3. The boom is then swung into position 128' and the spreader bar is connected to the ends of shaft 121 which can be lifted from cradles 122.

Figure 2:
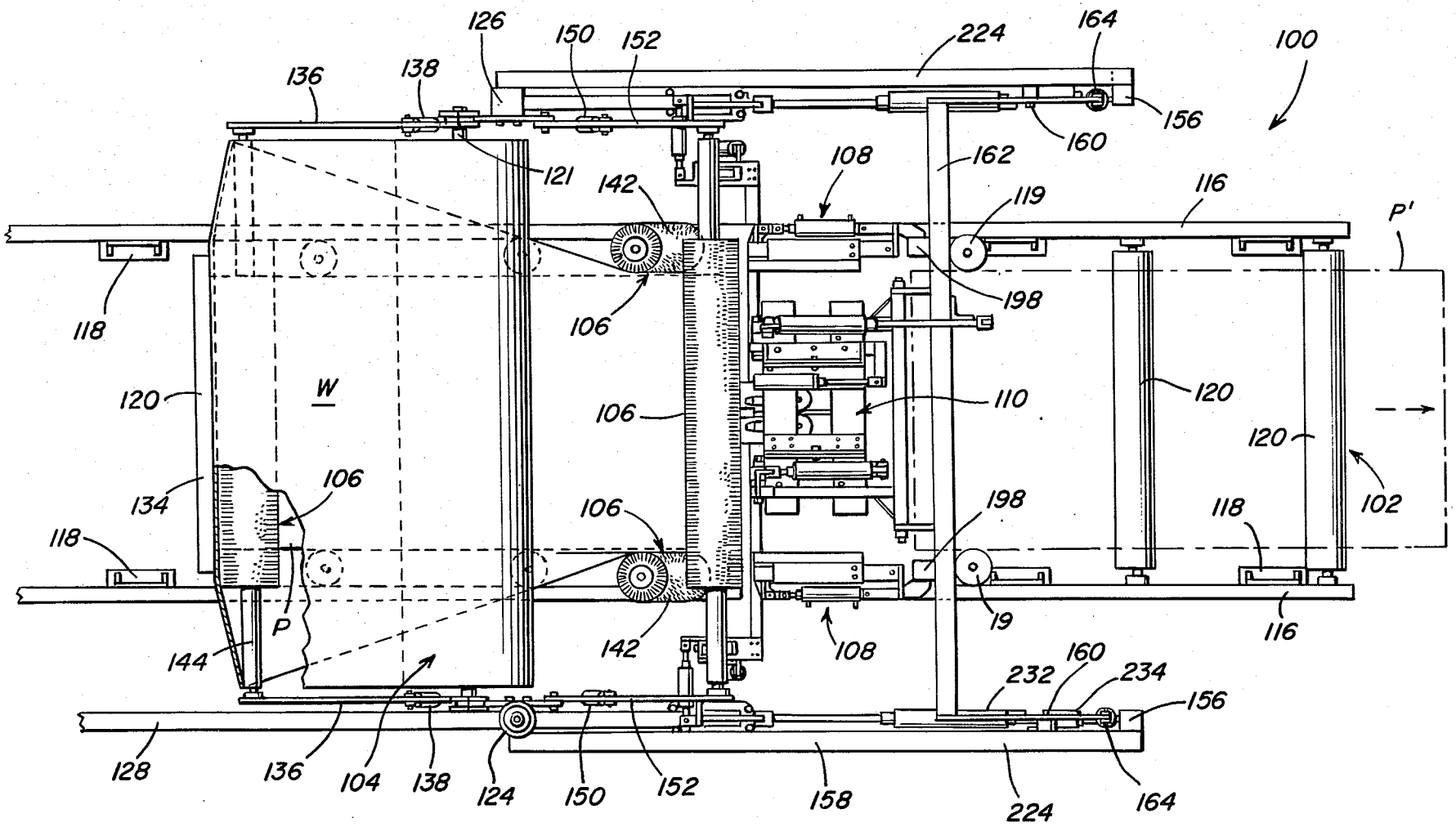
FIG. 2 is a top plan view of the package wrapping machine.
Figure 3:
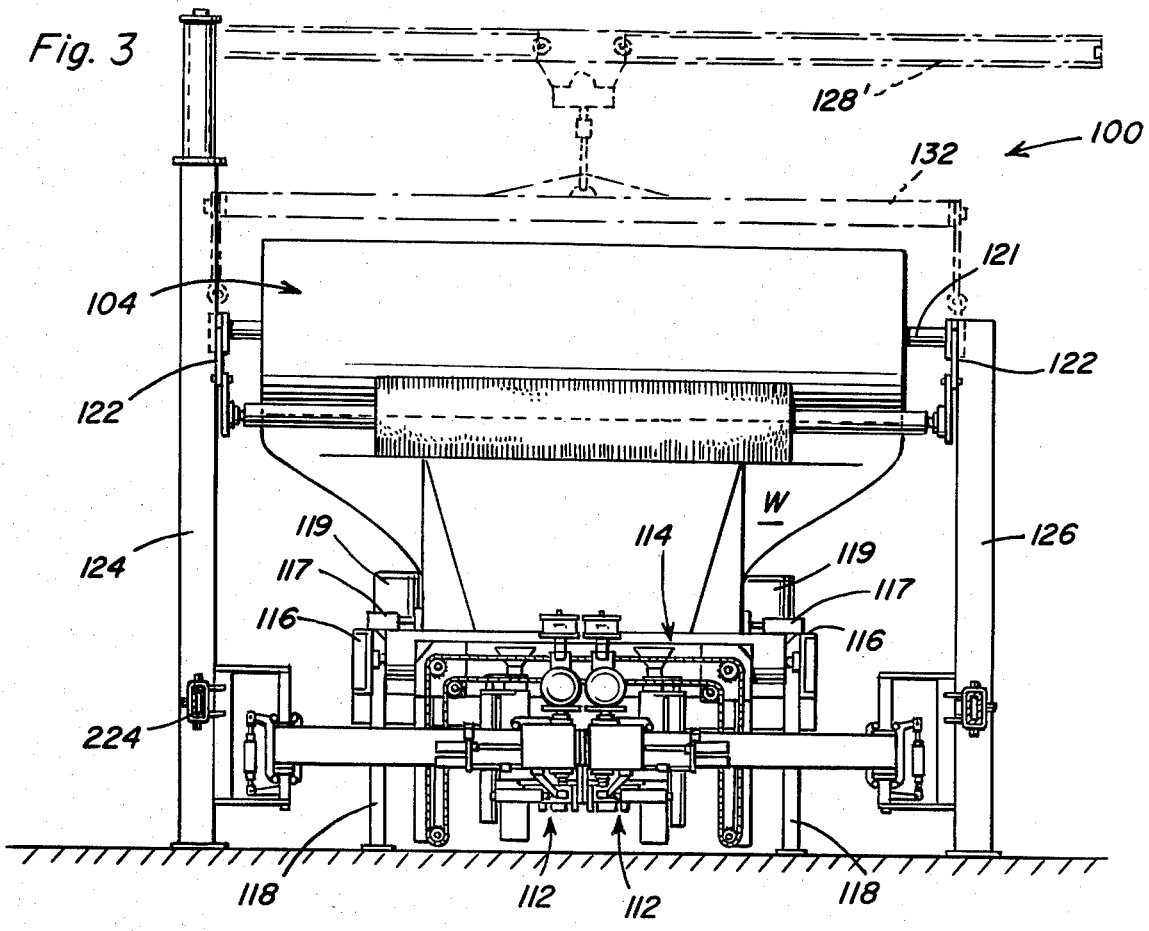
FIG. 3 is an end elevational view of the package vrapping machine. taken substantially along a plane ›assing through section line 3—3 of FIG. 1.
Figure 13:
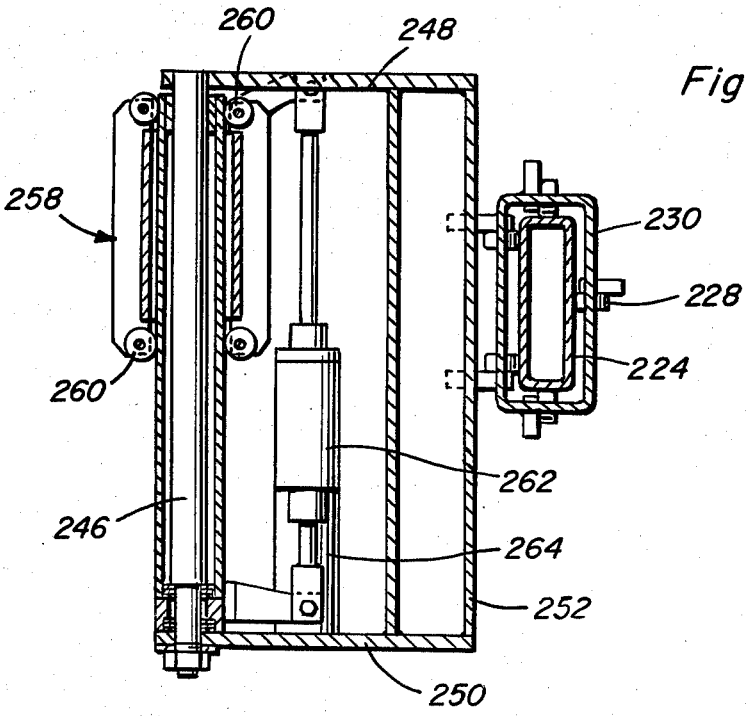
FIG. 13 is an end elevational sectional view taken ubstantially along a plane passing through section line 3—13 of FIG. 10 showing the lift mechanism for the tapler head travel beam.

Also seen in FIGS. 1 through 3 is the brush section 106. Brush section 106 includes distributing brush roller 134 which is positioned toward the front of the machine and held in place by a pair of arms 136 which extend from and are pivotally connected to cradles 122. Arms 136 are positioned through use of a pair of cylinders 138 which are respectively connected to the arms 136 and the mounted arms 140. Cylinders 138 control the height of roller 134 and thereby control the pressure applied from the roller to the package top surface. Wrapping material W extends from storage roll 104 around distributing roller 134 after which it extends along the top of the package and down along the sides of the package where it is held in place by diagonal brush rollers 142. It should be noted that distributing brush roller 134 extends to a position just beyond the lateral sides of position P after which the supporting shaft 144 for the roller 134 extends to arm 136. The shaft 144 has a diameter significantly less than that of roller 134. However, the wrapping material W extends for the entire length of the shaft 144. In this manner, the edges of the wrapping material W are positioned about a small diameter than the main body of the wrapping material and the surface of the wrapping material experiences a forward slant towards its edges. This is necessary since the edges of the material must extend to the bottom of the package while the main body of the material only has to lay on the top surface of the package. The extra distance to the bottom of the package is compensated for by allowing the material to wrap around the smaller diameter shaft 144 thus providing a bending of material at its point of origin in the vicinity of roller 134. As was mentioned above, the material is held against the sides of the package by the use of diagonal brush rollers 142. These rollers are slanted backwardly away from the leading end of the package and are caused to rotate in a direction opposite to that of the package movement, thus causing a downward and rearward force to be applied to the wrapping material W. This force causes the material to be tightly fit around the package exterior. Brush rollers 142 are powered operated through the use of electric motors, pneumatic motors, or the like. One additional roller of the roller set 106 is top holddown roller 146. This also is a brush roller and is mounted in a similar manner to that of roller 134. Roller 146 contacts the package top for holding material tightly thereagainst. Roller 146 is supported by a pair of support arms 148 which are attached to the cradles 122. Arms 148 are supported by pneumatic cylinders 150 which extend between the arms and mounting arms 152. As with cylinders 138, cylinders 150 control the height of roller 146 and therefore the pressure exerted by that roller against the package top.

Figure 4:
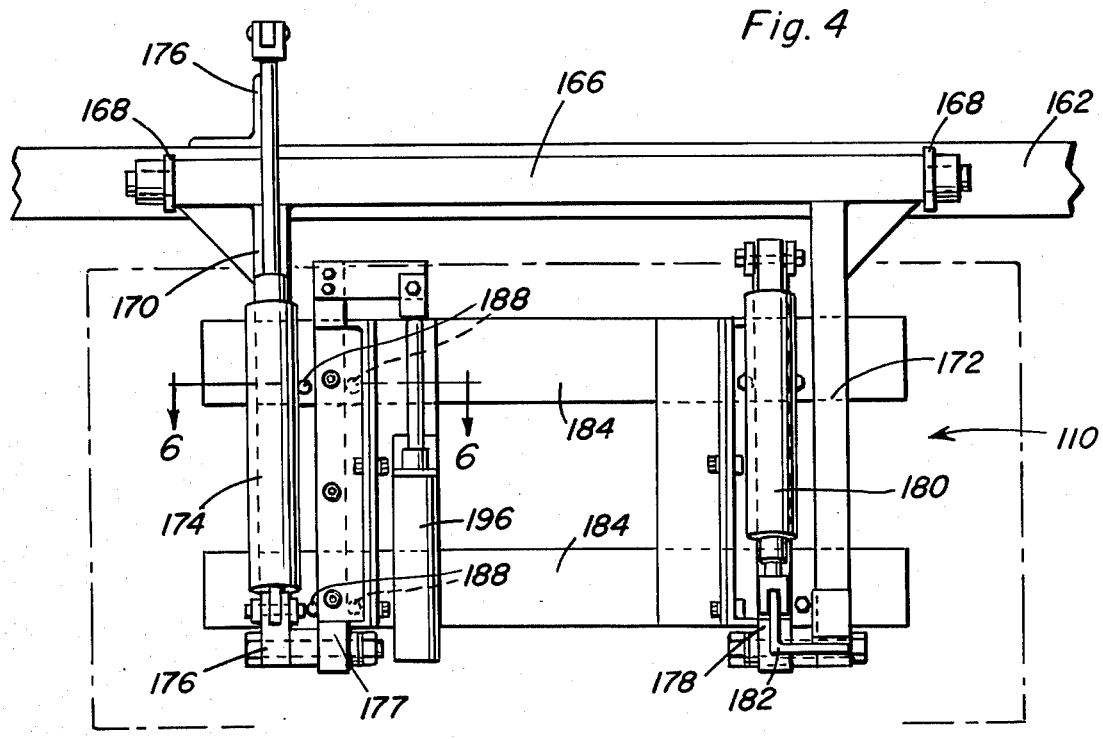
FIG. 4 is a top plan view of the center fold frame of he package wrapping machine.

In FIGS. 1 and 2, it will be seen that a fold frame support structure 154 is connected to the side fold frames 108 and center fold frame 110 for supporting and positioning these fold frames. This structure includes a pair of upright pillars 156 which are stabilized by horizontal support bars 158 which extend from pillars 156 to pillars 124 and 126, respectively. Pillars 156 pivotally mount a pair of fold frame support arms 160 which are connected by fold frame support spreader bar 162. Arms 160 are held in position by a pair of cylinders 164 which are operative to pivot the arms about their connection to pillars 156 and thereby control the vertical height of spreader bar 162. Directly connected to the spreader bar 162 is the center fold frame assembly 110 as can be most clearly seen with reference to FIGS. 4 through 6. The center fold frame has an outer fold frame pivot bar 166 which is pivotally attached to spreader bar 162 at bosses 168. Fixedly attached to pivot bar 166 are a pair of outer fold frame arms 170 and 172. Pivotally attached to the free end of arm 170 is the body of outer fold frame pivot cylinder 174. The piston of this cylinder is pivotally connected to offset 176 which is fixedly attached to spreader bar 162 with the offset extending vertically above bosses 168, as is clearly depicted in the figures. A pair of inner fold frame arms 177 and 178 are pivotally connected to the free ends of arms 170 and 172. Inner fold cylinder 180 is mounted on inner arm 178 at the free end of that arm and has its piston connected to an offset 182 which extends laterally from outer arm 172. Connected between the inner arms 177 and 178, are a pair of vacuum tubes 184. Vacuum tubes 184 contain a plurality of apertures 186 through which a vacuum is communicated with the wrapping material and by which the material is held against the vacuum tubes. These tubes are connected to arms 177 and 178 via slides. Depicted in detail in FIG. 6 is the slide on arm 177. Each slide consists of four wheels 188, with two wheels being attached to each vacuum tube 184 and having their axes extending backward therefrom. The wheels 188 abut against the sides of arm 177 and roll thereon. An angle iron 190 is attached between the vacuum tubes 184 and one arm extending backward therefrom and mounting four additional wheels 192. These wheels ride on plate 194 which extends laterally of arm 177. In this manner the vacuum tubes move as a unit longitudinally along arms 177 and 178. A slide cylinder 196 has its body connected to angle iron 190 and its piston connected to arm 177.

Figure 5:
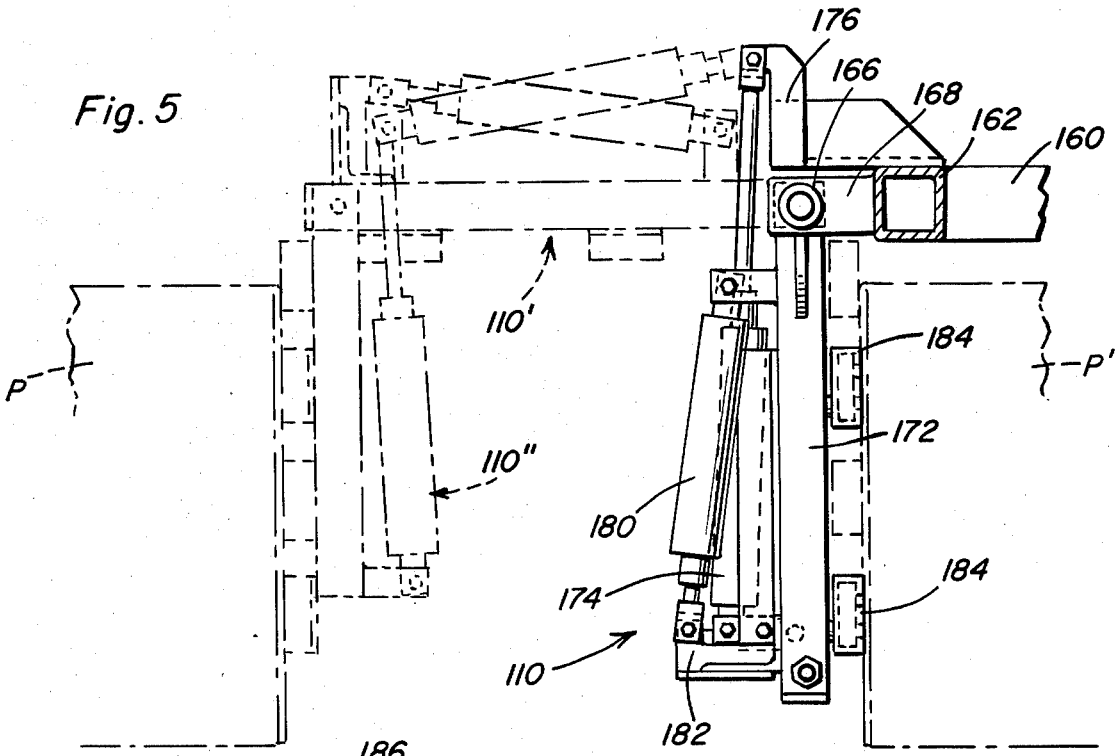
FIG. 5 is a side elevational view of the center fold rame showing the positioning of the center fold frame or engaging a package leading edge and a package railing edge.
Figure 6:
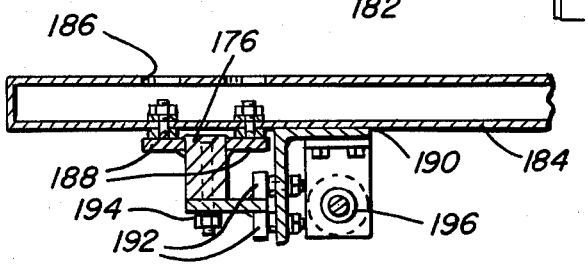
FIG. 6 is a fragmented sectional view taken substanially along a plane passing through section line 6—6 of FIG. 4 showing the slide mechanism of the center fold rame.

In operation, outer piston cylinder 174 has its shaft retracted placing the outer fold frame arms 170 and 172 in the horizontal position as shown in phantom in FIG. 5 at 110'. With inner fold frame cylinder 180 also in the retracted position, the entire fold frame is in the horizontal configuration which allows the package to pass thereunder. When it is desired to fold wrapping material on the leading end of a package, the package would be in position labelled P in FIG. 5. Inner fold frame cylinder 180 would extend its piston and this would cause the inner arms 177 and 178 to pivot downwardly into the position depicted in FIG. 5 in phantom and labelled 110''. This movement would cause the vacuum tubes carrying wrapping material to contact the leading end of the package at P, at which time cylinder 196 would extend its piston causing the vacuum tubes to move downwardly along the leading edge of package P pulling the wrapping material taut therealong. After the material is secured in place and the vacuum removed, cylinder 180 would retract its piston forcing the entire fold frame into its horizontal disposition shown in phantom in FIG. 5 at 110'. The package would move beneath the fold frame and assume the position P' shown in FIG. 5. At this time the cylinder 174 would extend its piston causing the entire fold frame to assume the vertical position shown in FIGS. 4 and 5 at 110 with the vacuum tubes carrying any wrapping paper held against them to a position adjacent the trailing end of the package at P'. At this time cylinder 196 would retract its piston forcing the vacuum tubes downwardly to make the wrapping paper taut on the package. Thereafter, the material would be secured in place. Of course, other operations may intervene as will be described in detail hereinafter.

Again with reference to FIGS. 1 and 2, it can be seen that a pair of vertical supports 198 are attached in depending position to spreader bar 162 for supporting the side fold frames 108. Side fold frames 108 are symmetrical in configuration and identical in function. The structure and function of the fold frames will be set forth with respect to the right side fold frame which is shown in detail in FIGS. 7 thru 9. In FIGS. 7 and 8, it can be seen that fold frame 108 is pivotally attached to one vertical support member 198 through outer fold frame member 200. An outer frame pivot cylinder 202 is pivotally connected to the free end of member 200 and has its piston attached to an offset connector 204 which is attached to vertical support 198. In this manner, by an extension of the piston of cylinder 202 the entire fold frame pivots about the attached end of member 200. Also attached to the free end of member 200 is inner frame member 206. Member 206 is pivotally connected to member 200 and has attached thereto an inner frame pivot cylinder 208 which has one end connected pivotally to member 206 and a piston which is pivotally connected to offset boss 210 which extends from member 200. In this manner, with the piston of cylinder 208 extended, the inner frame member 206 will pivot about the free end of member 200. A vacuum tube 212 is mounted on inner frame member 206 and disposed for longitudinal movement therealong. Vacuum tube 212 has apertures 214 disposed therein for allowing the vacuum to communicate with wrapping material which is held against the vacuum tube. A typical slide construction is shown in FIG. 9 wherein it can be seen that vacuum tube 212 is mounted on slide member 216. Slide member 216 surrounds member 206. Roller wheels 218 are attached to member 206 and abut against one inner surface of side 216 while a second pair of roller wheels 220, which have their axes perpendicular to the axis of wheels 218, are attached to the slide member 216 and ride on inner frame member 206. In order to cause movement of the slide and attached vacuum tube along inner frame member 206, a slide cylinder 222 is connected with one end pivotally attached to the slide 216 and with its piston pivotally attached to inner frame member 206. In operation, it can be seen that with a package in position P in FIG. 8, inner pivot cylinder 208 may be actuated to extend its piston thereby pivoting inner frame member 206 and vacuum tube 212 against the leading edge of a package to be wrapped, carrying with it wrapping material which is held against the vacuum tube by a vacuum therein. By actuation of slide cylinder 222, the vacuum tube 212 can be slid across the face of the leading end of the package thereby pulling the wrapping material taut on the package. After the leading edge is secure, the inner frame pivot cylinder piston is retracted bringing inner frame member 206 to its original position shown in FIGS. 7 and 8. The package is advanced past the side fold frames at which time the outer frame pivot cylinder 202 is actuated thus bringing vacuum tube 212 into engagement with the trailing end of a package, which is now disposed in position P'. The piston of slide cylinder 222 would then be retracted thus forcing the vacuum tube 212 across the face of the trailing edge of the package being wrapped thereby making the wrapping material taut on the package.

Again with reference to FIGS. 1 through 3, it can be seen that a pair of horizontal support members 224 extend respectively between pillar 124 and pillar 156 on the right side of the machine and pillar 126 and pillar 156 on the left side of the machine. Each of these members 224 supports a separate one of the stapler systems 112. Each of the stapler systems 112 is responsible for stapling the wrapping material W to one-half of the package being wrapped. The systems 112 are identical in function and symmetrical in construction. Therefore, only the right side staple system 112 will be described in detail. The right side staple system can be seen in detail in FIGS. 10 through 15, as well as FIGS. 1 through 3. Especially with reference to FIGS. 1, 2, 10 and 12, it can be seen that the entire stapler system 112 is supported for longitudinal movement along member 224 by a roller cage 226. Roller cage 226 includes a plurality of wheels 228 which are mounted in housing 230 and surround member 224 for allowing the housing to slide therealong. The position of the housing and therefore the stapler system is determined by the position of the pistons of staple assembly travel cylinders 232 and 234. These cylinders are connected in series between housing 230 and pillar 156. Cylinder 232 has a stroke of preferably 18 inches and is connected directly to the piston of cylinder 234 which has a stroke of four inches giving a total movement for the stapler system 112 of 22 inches. Attached to housing 230, is a generally rectangular support carriage 236 which includes a vertical support member 238 on which rides lateral stapler head travel beam 240. Mounted on the beam 240 is the stapler head 242. Head 242 is fed from a continuous roll of staple material 245 which is positioned behind the head 242. The nose 244 of the stapler contains a rolling wheel assembly which will rotate in both the horizontal and vertical planes so as to allow the head to be pressed firmly against the package being stapled. In order that the nose 244 can be held against the package, vertical support member 238 is pivotally mounted about pivot shaft 246 of support carriage 236. Pivot shaft 246 is connected at its end to upper and lower arms 248 and 250 which are in turn mounted firmly to vertical support 252 of the carriage. A pivot cylinder 254 is mounted to housing 230 at one end and has its shaft mounted to lateral extension 256 which is firmly connected to vertical support 238. Accordingly, by an actuating cylinder 254 in the appropriate direction with an appropriate pressure, support 238 will pivot about shaft 246 causing beam 240 to pivot with head 242 connected thereto forcing nose 244 against a package at P.

Furthermore, three position height adjustment for the stapler head travel beam 240 is afforded. Roller cage 258 is attached to beam 240 and contains wheels 260 which allows beam 240 to move vertically on support 238. Positioning of the beam 240 is controlled by vertical rise cylinders 262 and 264 which are connected by plate 266. Cylinder 262 has its piston attached to vertical support 238 while the piston of cylinder 264 is attached to roller cage 258. Accordingly, with selective extension or retraction of these pistons three positions may be assumed by beam 240.

Figure 15:
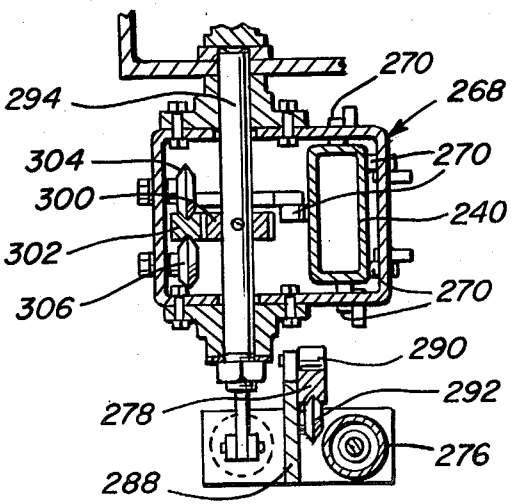
FIG. 15 is a side elevational view taken substantially long a plane passing through section line 15—15 of FIG. 14 showing the head rotating mechanism of the tapler apparatus.

Furthermore, the head 242 is capable of moving laterally along beam 240. This motion is allowed by the use of roller cage 268 shown in FIGS. 10 through 15. In FIG. 15, it can be seen that roller cage 268 includes a plurality of wheels 270 which surround beam 240 for allowing motion of the roller cage therealong. Eight positions for the head 242 are provided for by the use of three stapler head travel cylinders, 272, 274 and 276. A separate guide track, track 278, is positioned below beam 240 for supporting the weight of the cylinders. Cylinder 272 is preferably a four inch stroke cylinder and has its piston connected to support plate 280 which is connected to the end of beam 240 and supports guide track 278. The body of cylinder 272 is attached to plate 282 and also to the shaft of cylinder 276. Plate 282 is supported on track 278 by a pair of rollers 284 and a pair of knife edge rollers 286. The body of cylinder 276 preferably has a 16 inch stroke. The body of 276 is connected to cylinder 274 through plate 288. Plate 288 is mounted on track 278 through the use of flat rollers 290 and knife edge rollers 292. The piston of cylinder 274 is attached to arm 293 which extends below cage 268. Accordingly, through the use of cylinders 272, 274 and 276, eight positions can be obtained by stapler head 242, with these positions being spaced at four inch intervals along beams 240. For reference purposes, the positions are numbered 1 through 8, with position 1 being closest to the free end of beam 240 and position 8 being closest to support carriage 236.

Figure 10:
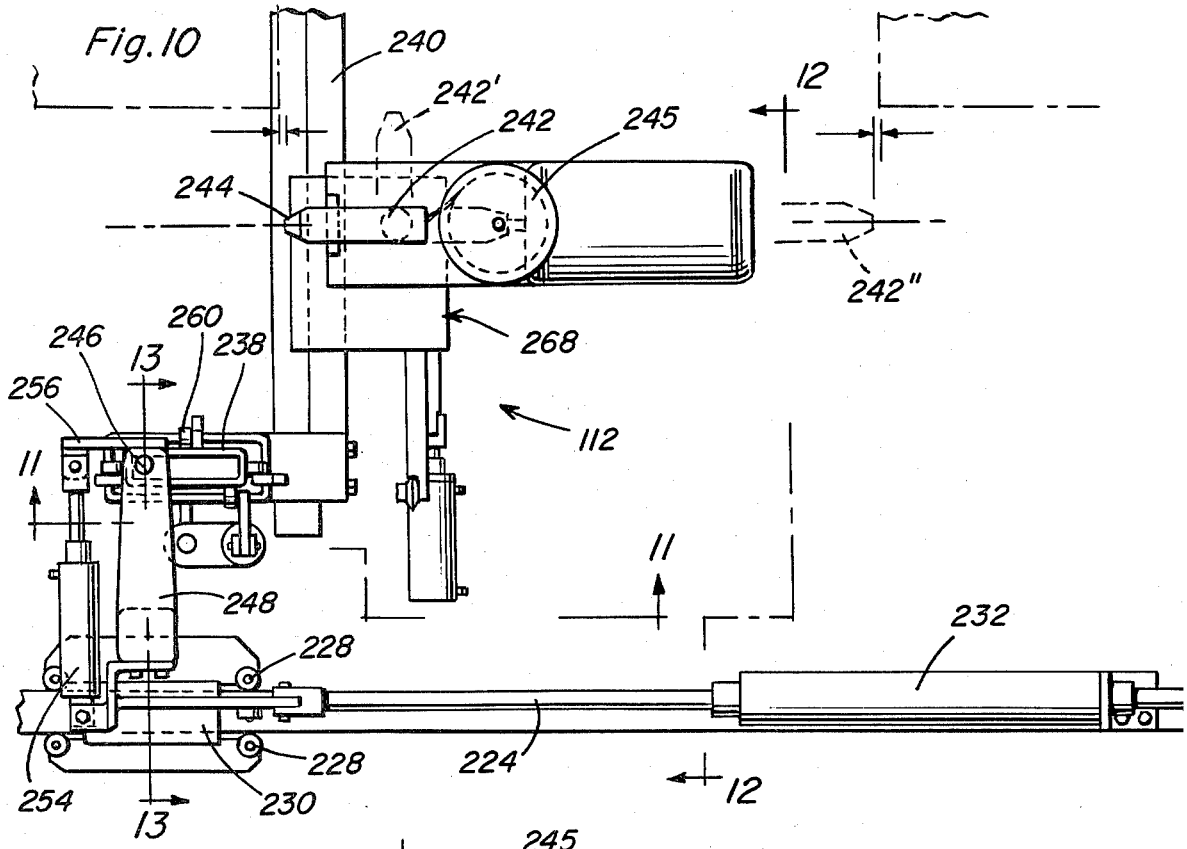
FIG. 10 is a top plan view of the stapling apparatus of he present invention showing the three positions asumable by the stapler head for stapling the leading dge, side and trailing edge of a package.
Figure 11:
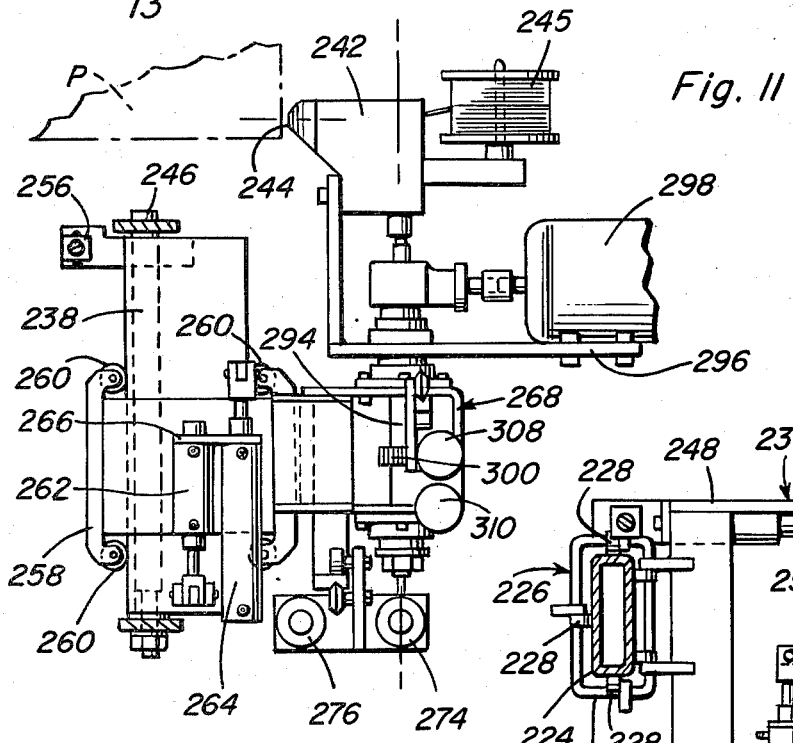
FIG. 11 is a side elevational view of the stapling pparatus taken substantially along a plane passing hrough section line 11—11 of FIG. 10.
Figure 12:
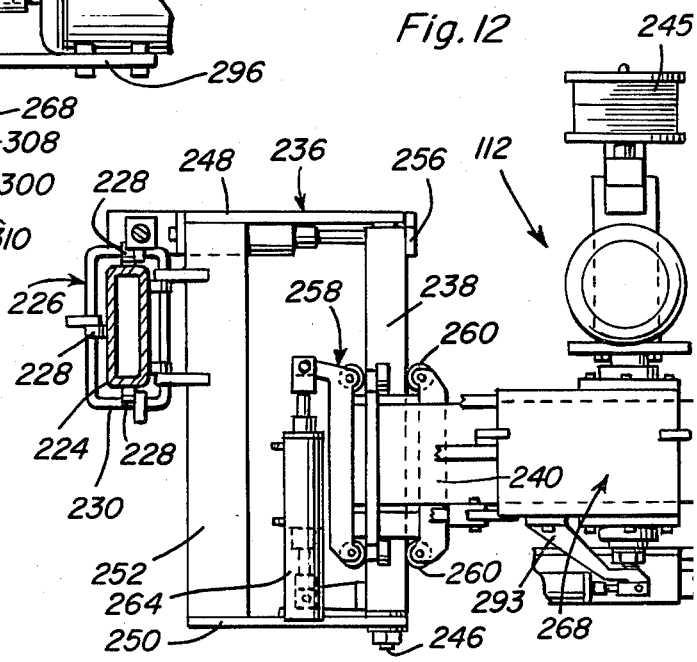
FIG. 12 is an end fragmental elevational view of the tapling apparatus taken substantially along a plane ›assing through section line 12—12 of FIG. 10 showing he lift mechanism for the stapler head travel beam.
Figure 14:
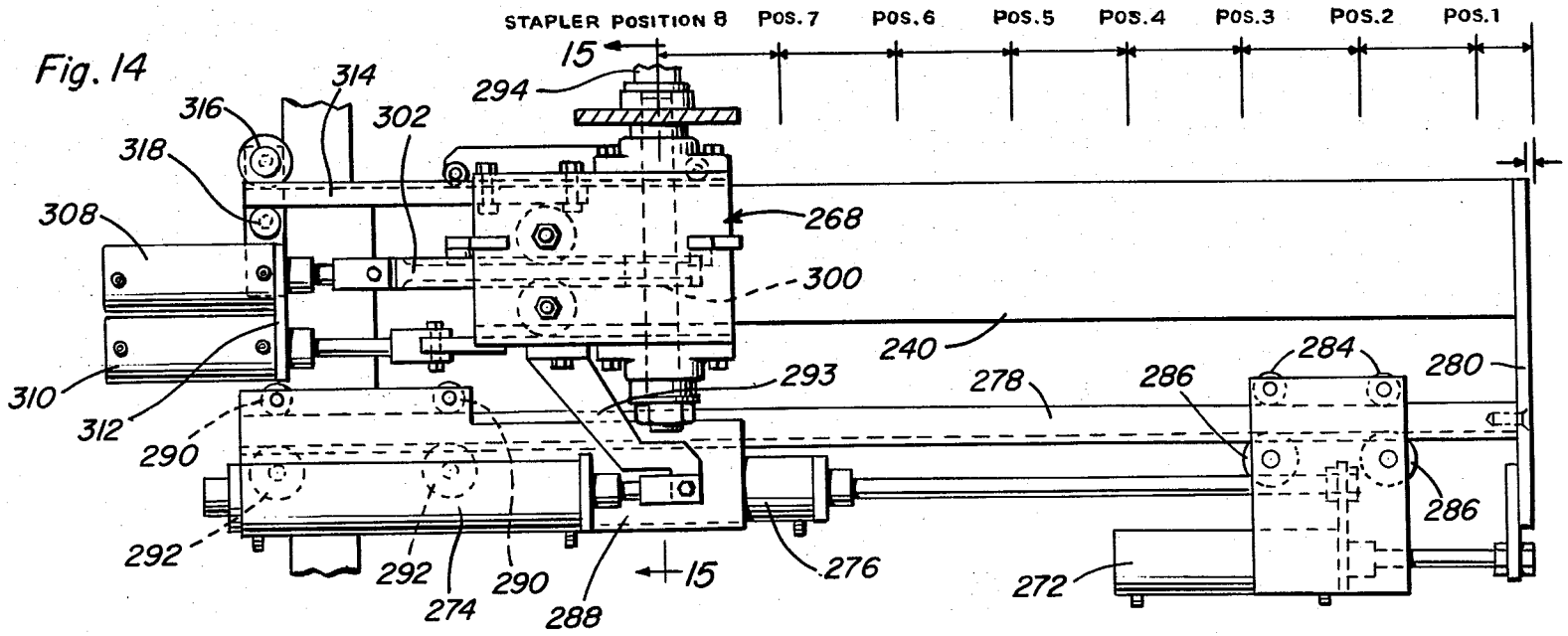
FIG. 14 is a fragmental end elevational view of the tapler head travel beam showing the head positioning nd rotating mechanisms.

Head 242 can assume three orientations, as depicted in FIG. 10 at 242 and in phantom in FIG. 10 at 242' and 242". In order to allow head 242 to pivot, the head is mounted on the cage 268 through a pivot shaft 294, shown in FIGS. 11, 12, 14 and 15. Also mounted for rotation on shaft 294 is platform 296 which supports motor 298 which may be a 1/6 horsepower electric motor for operation of head 242. Rotation of shaft 294 is accomplished through the use of pinion gear 300 which operatively engages rack 302. These gears can most clearly be seen in FIGS. 11, 14 and 15. Rack 302 is supported within the cage 268 by upper and lower knife edge rollers 304 and 306. Motion of rack 302 relative to pinion 300 is accomplished through the use of cylinders 308 and 310, each of which has a stroke of two inches. Cylinders 308 and 310 have their bodies connected together by plate 312 which is itself supported on guide track 314 which extends from cage 268. Plate 312 is supported on track 314 by knife edge roller 316 and flat roller 318. The piston of cylinder 310 is connected to cage 268 while the piston of cylinder 308 is connected to the rack 302. Thus it can be seen that actuation of cylinder 308 by extension of its piston will cause rack 302 to move forwardly causing rotation of pinion gear 300 thereby rotating shaft 294 by 90° placing head 242 in position 242' in FIG. 10. Actuation of cylinder 310 through retraction of its piston will cause the bodies of cylinders 310 and 308 to move forwardly on track 314 thus causing rack 302 to move forward rotating pinion 300 another 90° placing head 242 in position 242" as seen in FIG. 10. These positions are necessary for stapling the leading edge, side and trailing edge, respectively, of a package.

The final section of the package wrapping machine is the sheet slitter 114 shown in FIGS. 16 through 19 which is located in the region of side and center folding frames 108 and 110. The slitter 114 includes a slitter frame 320 which is carried by a pair of vertical telescoping extensions 322 and 324. A pair of sleeves 326 are welded to the extensions 322 and 324 respectively. Sleeves 326 ride on horizontal guide members 328. A pair of slitter travel cylinders 330 and 332 are attached between sleeves 326 and guides 328 for moving the slitter frame along the guides. A cross member 334 is attached between guides 328 and the body of cylinder 330 is securely fastened thereto. A second cross member, cross member 336, is connected between sleeves 326 and has the body of cylinder 332 securely fastened thereto. The pistons of cylinders 330 and 332 are connected to each other. Cylinder 330 has a stroke of seven inches while cylinder 332 has a stroke of 19 inches allowing the slitter frame to assume three separate positions on guides 328.

The slitter frame 320 includes laterally spaced uprights 338 which are connected at their top ends by vacuum tube 340. Vacuum tube 340 has its vacuum apertures disposed along its upper surface for holding wrapping material against the top of the slitter frame. Each of the uprights 338 has a clamp 342 attached to its lower end. Each clamp 342 includes a clamp cylinder 344 which actuates a clamp face plate 346 which serves to hold wrapping material against the uprights 338 during the slitting procedure to be described.

Figure 16:
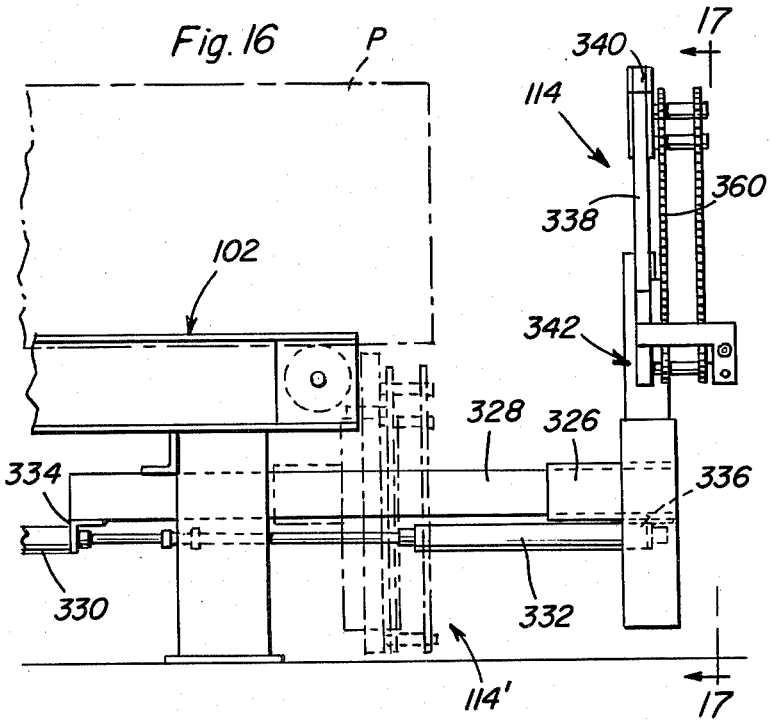
FIG. 16 is a fragmental side elevational view showing he slitter apparatus of the package wrapping machine.

Each of the vertical extensions 322 and 324 has an inner arm 348 which is connected directly to vacuum tube 340. Inner arms 348 slide into sleeves 350 which themselves telescopically slide within bases 352. A first extension cylinder, cylinder 354, is connected between the base of extension 324 and sleeve 350 of that extension. A second cylinder, cylinder 356, is connected between the sleeve of extension 322 and vacuum tube 340. As can easily be seen with reference to FIG. 17, the connection of these cylinders in this manner allows each telescopic extension to be disposed in the fully extended position or the fully retracted position. FIG. 16 depicts the slitter mechanism and its quiescent position at 114' wherein the mechanism is disposed beneath the leading edge of a package located in position P. It should be noted that in FIG. 16, the brush roller mechanism 106, the fold frames and the stapler mechanisms have been left out for clarity. Furthermore, in FIGS. 1 and 2, the slitter mechanism has been omitted to more clearly show the other sections of the machine.

Figure 18:
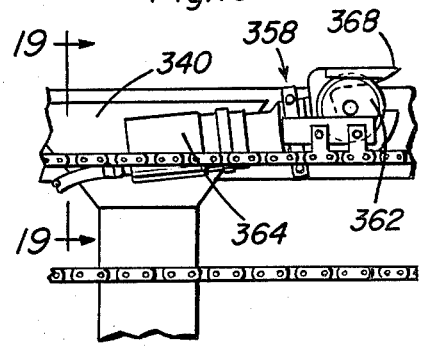
FIG. 18 is an enlarged fragmental view showing the litter of FIG. 17.
Figure 19:
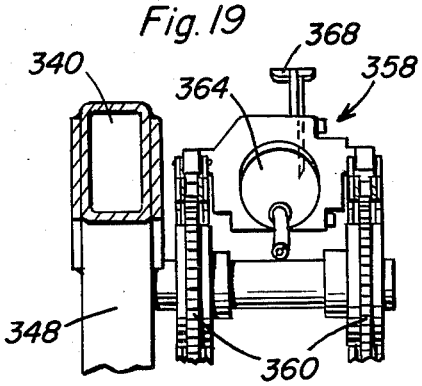
FIG. 19 is a side elevational sectional view taken ubstantially along a plane passing through section line 9—19 of FIG. 18.
Figure 17:
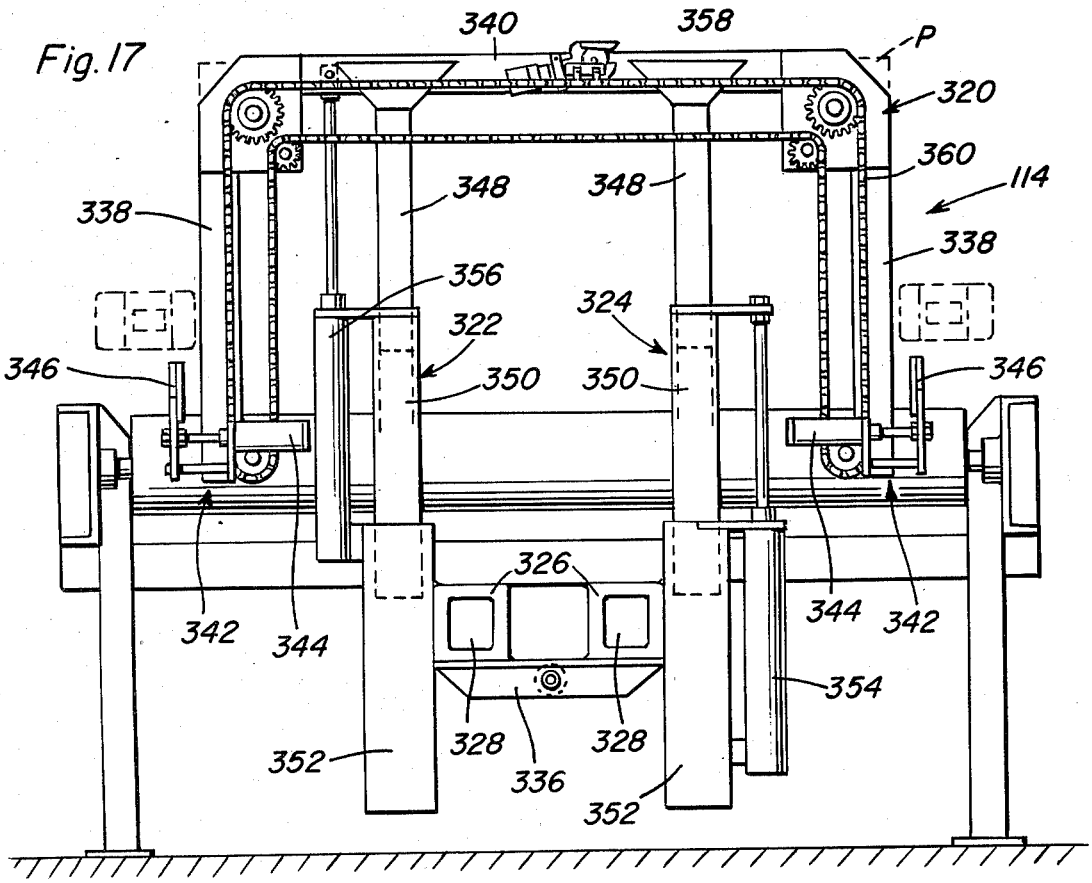
FIG. 17 is an end elevational view of the slitter appaatus shown in its vertically extended, slitting position.

The slitter itself is referred to by the reference numeral 358 and shown in FIGS. 17 through 19. The slitter rides on two chains 360, each of which is configured in an endless loop. The chains are driven by a small gear motor which can be mounted in driving relationship to any one of the support gears for the chains 360. As can be clearly seen, the chains 360 are held in a generally rectangular configuration for guiding the slitter 358 along wrapping material which would be disposed about the outer periphery of slitter frame 320. Clamps 346 serve to hold the ends of the material against uprights 338 while the vacuum in vacuum tube 340 would hold the material against that portion of the frame while the slitter 358 is active in severing the material. The slitter itself is shown in FIGS. 18 and 19 and can be seen to include a rotating blade 362 which performs the slitting operation. Blade 362 is attached to a motor 364 which may be air operated, hydraulic or electric. The blade and motor combination is attached between chains 360 which guide it about the slitter frame holding guide 368 above the frame outer periphery for channelling the material to be severed into blade 362.

OPERATION OF THE PACKAGE WRAPPING MACHINE

In operation, a package is conveyed into the machine on roll case 102. A limit switch senses the leading edge of the package and turns off the roll drive and sets a brake, thus disposing the package in position P. Air operated rubber faced clamps 117 are actuated approximately three seconds after the roll case limit switch disconnects power to the gear motor and sets it brake. These clamps hold the material W to the sides of the package. Left and right side fold frame 108 and center fold frame 110 have wrapping material held against them by their respective vacuum tubes. The left and right side fold frame inner frame members are rotated by actuation of cylinders 208 and wrapping material is folded against the leading end of the package. The slide cylinders 222 are actuated for pulling the paper taut across the leading end of the package against the holding action of lamps 117. The force exerted by the slide cylinders on material W is adjusted by an air regulator in the line to the valve controlling the slide cylinders. At this time, the right side stapler head travels to the center of the package and begins the stapling sequence from the inside out. The left side stapler moves to staple position 6 at the outside edge of the packaging and begins the stapling sequence from the outside inward. The left and right staplers both begin stapling at 1⅛ inch from the top of the roll case rolls 120. This position seats the staples accurately into the wood of the wood package. During the stapling sequence, cylinder 254 of each stapler mechanism is actuated to force the nose 244 of stapler head 242 firmly against the package leading end to insure accurate stapling. After the right side stapler has actuated, the six inch vertical rise cylinder 264 moves the entire stapler assembly vertically and staples the folded edge of the sheet $1\frac{1}{8}$ inch from the top of the rolls 120. The six inch cylinder then returns the stapler to the $1\frac{1}{8}$ inch position.

Each stapler head is capable of assuming eight positions as discussed hereinabove. Of the eight positions, six positions are used for stapling one-half of the package end, the seventh position is unused and position eight is the clearance and package side stapling position. Each stapler moves into position, stops, places its staple and then moves to the next position. Each stop is controlled by one of the three air cylinders attached to beam 240 and roller cage 268.

When the right side stapler reaches its position number eight, it stops. When the left side stapler reaches its position number one, it moves vertically six inches, staples, moves down six inches vertically and returns to position number eight and also stops. The vacuum on both side fold frames 108 is released and both right and left fold frame 108 open to the package clearance position shown in FIG. 8.

Figure 20:
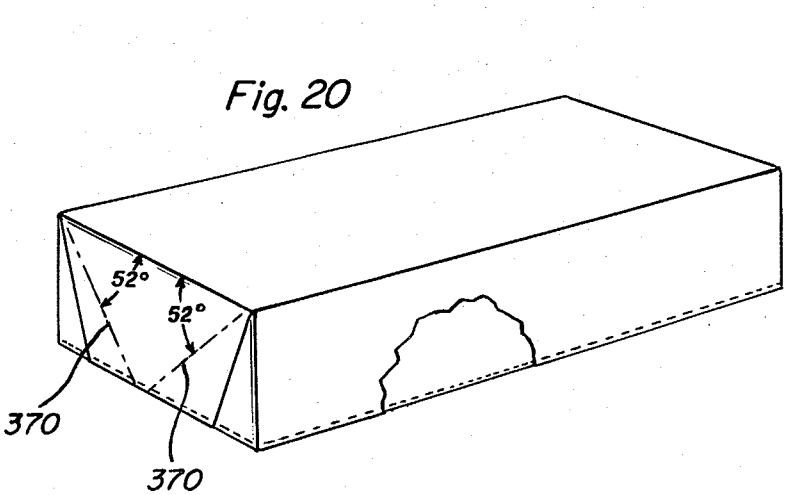
FIG. 20 is a perspective view of a package wrapped y the package wrapping machine of the present invenion.

At this time center fold frame 110 inner arms 177 and 178 are pivoted by actuation of inner pivot cylinder 180 into a position adjacent the leading edge of the package. The center fold frame vacuum tubes 184 carry with them the last flap of the wrapping material producing a modified square end wrap as seen in FIG. 20. The vacuum holes and vacuum tubes 184 are arranged in a 52° line from the horizontal top edge of the package as depicted by dotted lines 370 in FIG. 20. For a two foot high by four foot wide nominal package, this is the natural fold line established by experiment. After the inner arms of the fold frame have pivoted, the slide cylinder 196 is actuated causing a downward movement of vacuum tubes 184 to pull the last flap of the wrapping material taut on the package. Again, the force exerted by the slide cylinder on the sheet is adjusted by an air regulator in a line to the valve controlling the slide cylinder. At this time, the right and left staplers both begin stapling at position six and staple toward the center of the package with the $\frac{3}{4}$ inch vertical rise cylinder 62 actuated. Cylinder 262 places the line of staples at $\frac{7}{8}$ inch above the top of rolls 120. This avoids placing this line of staples on top of the existing line at $1\frac{1}{8}$ inch above the roll. The left side stapler stops at position two. The right stapler stops at position one. The vacuum in the center fold frame vacuum tube 184 is then released and the inner arms rotate upwardly into the horizontal position 110' shown in FIG. 5. The right side stapler then raises vertically six inches by a six inch stroke rise cylinder 264 and staples at $7\frac{7}{8}$ inches above the top of rolls 120. The stapler head then lowers vertically six inches to the starting position at $1\frac{7}{8}$ inch above the top of the rolls. The stapler then returns to the clearance position eight. The left side stapler then moves to position one, and staples. Next it raises vertically six inches and staples at $7\frac{7}{8}$ inches above the top of the rolls. The left side stapler then lowers six inches to the $1\frac{7}{8}$ inch position and returns to clearance position eight. Both package side clamps 117 now retract. The leading edge of the package is now completely folded and stapled.

The rolls 120 are not activated and carry the package through the machine. At this point, the wrapping material stapled to the leading edge of the package unwinds the paper from storage roll 104, around and beneath distributing roller 134 and beneath roller 146. Rollers 134 and 146 serve to hold the wrapping material on top of the package and prevent wind from blowing it off the package. The outside edges of the wrapping material transition from a horizontal disposition after distributing roller 134 to a position with the center of the material held in a horizontal plane between roller 146 and the package top, and a vertical disposition along the sides of the package. The diagonal brush rollers 142 are canted upstream at an angle of 30°. These rollers are driven through a right angle miter box coupled to the roll case roll positioned beneath them. The rolls are rotated against the flow of the package to smooth and flatten the wrapping material to the lumber package, and expel air from between the lumber and the paper. The 30° cant provides frictional force vectors which both pull the paper rearward and downward. This provides a tight fitting paper wrapping. Rollers 142 may be pivoted against the side of the package by an air cylinder whose air supply is pressure regulated to adjust the force between the roller and the package.

Both stapler heads 242 rotate 90° through the action of rack and pinion 300, 302 and the actuation of one of the air cylinders 308, 310. Pivot cylinder 254 rotates the beam 240 such that the nose 244 of each stapler head comes into contact with one side of the package moving therepast. The staplers staple "on the fly", actuated by switch trip pins placed at 180° intervals on the roll case roll 120 closest to the stapler head. This places staples at approximately $10\frac{1}{2}$ inch intervals down the sides of the package.

When the first mentioned limit switch is released because the package has cleared it, both rollers 134 and 146 are raised through the action of cylinders 138 and 150 to a clearance position. The roll case 102 drives the package until the trailing edge of the package releases a second limit switch positioned between vertical supports 198. This switch turns off the roll drive and sets its brake, positioning the package in position P'. This switch is also effective to apply vacuum to the slitter vacuum tube 340, as well as the vacuum tubes of all of the fold frame. This limit switch also starts air operated slitter motor 364. At this time the pivot cylinders 354 reverse, pulling the stapler heads 242 away from the sides of the package and the stapling ceases. The seven inch stroke slitter positioning cylinder 330 extends its piston, thereby placing the slitter frame two feet from the rear of the trailing end of the package. The 18 inch stroke stapler assembly travel cylinders 232 then retract moving the stapler assemblies 18 inches to the trailing end stapling position. The two vertical cylinders 354 and 356 extend raising the telescoping extensions 322 and 324 to their maximum thereby disposing the slitter frame 320 directly adjacent the wrapping material. Clamps 342 on the slitter frame then clamps the sheet against the sides of the slitter frame and the slitter chain drive motor is actuated. The slitter travels up the right side of the wrapping material sheet, across, to the left side, and down the left side of the slitter frame separating the sheet. At this point the slitter carrier chain gear motor reverses, returning the slitter to the home position on the right side of the machine. The seven inch stroke slitter frame travel cylinder 330 then retracts with the sheet's slit end being held by the vacuum at the top of the slitter vacuum tube 340, and at the sides by the two side clamps 342.

The trailing end folding sequence now begins. The slide cylinders 222 are in their extended positions from folding the leading end of the package. The right and left side fold frame outer frame pivot cylinders 202 extend to rotate the outer frame members 200, and thus the vacuum tubes, into contact with the trailing end of the package. The slide cylinders on both frames now retract pulling the material taut on the package.

Both stapler lift cylinders 262 and 264 extend, raising the stapler head $6\frac{3}{4}$ inches. The stapler heads now rotate an additional 90° through rack and pinion 300, 302, and the actuation of the other cylinders 308 and 310. This leaves the stapler heads pointing downstream in a position 180° from their original positions. Both stapler lift cylinders retract lowering the staplers to a position $1\frac{1}{8}$ inch above the top of the rolls. The right side stapler travels to the center of the package and places a staple at position one. The right side six rise cylinder 264 lifts the stapler travel beam, the stapler staples at this position and is then retracted to its original position $1\frac{1}{8}$ inch above the top of the roll. The left side stapler begins at position six and staples inward to position one, where it staples. The left side six inch rise cylinder lifts the stapler head beam, it staples at $7\frac{1}{8}$ inch above the top of the roll, and the cylinder retracts lowering the stapler to $\frac{1}{8}$ inch above the top of the roll. The left side stapler retracts to the number eight position and stops. The right side stapler retracts to the number eight position and stops. The vacuum in both side fold frames is now released and the side fold frames return to the normal clearance position.

The end fold sequence now begins. The center fold frame 110 is pivoted by outer frame pivot cylinder 174 and the vacuum tubes 184 are brought into contact with the trailing end of the package. The slide cylinder 196 retracts pulling the wrapping material taut on the package.

The final stapling sequence now begins. The right and left staplers both begin stapling at position six and staple toward the center of the package. The $\frac{3}{4}$ inch vertical lift cylinder places these staples at $1\frac{7}{8}$ inch above the top of the roll, as was the case with the stapling of the package leading end. This avoids placing this line of staples on top of the existing line of staples. The left side stapler stops at position two while the right side stapler stops at position one. The vacuum in the center fold frame vacuum tube is released and the frame rotates upward into the horizontal position. The right side stapler then rises vertically six inches and staples once. It is then lowered to its initial position and returns to clearance position eight. The left side stapler now moves to position one and staples. The left side stapler then rises vertically six inches and staples once. It is then lowered and returned to clearance position eight.

The package is now wrapped and ready to be conveyed from the machine by the roll case. The roll case awaits manual control from the operator or automatic control from a system controller.

The sheet which was separated by the slitter must now be reset into the fold frames. The stapler assemblies move downstream and additional four inches by the extension of four inch travel cylinders 234. This provides clearance for the slitter frame to enter the area within the fold frames. The slitter assembly travel cylinders move the slitter frame downstream 18 inches and 7 inches through the extension of air cylinders 330 and 322. This places the outside surface of the paper being held by the slitter frame $\frac{1}{2}$ inch from the vacuum surfaces of the right and left side fold frame vacuum tubes. Vacuum is pulled to both right and left side fold frame and to the center fold frame. The vacuum in the slitter frame is turned off after a three second time delay and the two clamp cylinders 344 release their grip on the paper. This transfers the paper from the slitter frame to the fold frames. The slitter assembly travel cylinder 332 retracts 18 inches and stops while the vertical lift cylinders 354 and 356 retract lowering the slitter frame to its clearance position $1\frac{1}{2}$ inches below the top of the roll case rolls. The seven inch stroke slitter frame travel cylinder 330 now retracts placing the slitter frame in its final clearance position as shown in FIG. 16 at 114'.

The staplers are now returned to their initial starting positions for beginning a new package. The stapler head pivot cylinders rotate the heads 180°, pointing them toward the leading end of the next package. Both stapler system travel cylinders extend, moving the staplers back to the leading end position. The package wrapping machine is now ready to accept the next package to be wrapped.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A package wrapping machine for covering a rectangular package with wrapping material on five sides, said machine comprising in combination;

a conveyor means for supporting the package and transporting it from one work position to another;

wrapping material storage and dispensing means for storing and dispensing a roll of wrapping material having a substantially constant width, said wrapping material storage and dispensing means being disposed over a portion of said conveyor means;

wrapping material holding means for holding said wrapping material in position on at least three sides of said package;

folding means for moving said holding means selectively against the leading and trailing ends of said package for folding said wrapping material against said package;

fastening means for fastening said wrapping material to said package and thereby drawing said material from the storage upon the movement of said conveyor means; and slitting means for slitting said material to provide material of a proper length to wrap said package.

2. The machine of claim 1 wherein said wrapping material storage and dispensing means includes a distributing roller positioned above a package to be wrapped for holding wrapping material against the top of said package, and a pair of side rollers positioned adjacent each side of the package to be wrapped for holding material thereagainst.

3. The machine of claim 2 wherein said pair of side rollers are slanted and rotate to pull the wrapping material downwardly and rearward of the package for removing wrinkles and the like from the wrapping material.

4. The machine of claim 2 wherein said side rollers are positioned in parallel planes which are orthogonal to the plane of said distributing roller, thereby causing the ends of said wrapping material to go through a transition of substantially 90° between the position at which the ends contact said distributing roller and the position at which the ends contact said pair of side rollers.

5. The machine of claim 4 wherein said distributing roller has a center portion for contacting the center of said wrapping material, said center portion having a first diameter; and end portions which contact the ends of said wrapping material, said end portions being of a substantially smaller diameter than said central portion for providing a smaller radius for the ends of said wrapping material to pass around for enabling said material to extend through the 90° transition without tearing.

6. The machine of claim 1 and further wherein said wrapping material holding means comprises a plurality of perforated tubes having a partial vacuum disposed therein for holding said wrapping material thereagainst.

7. The machine of claim 1 wherein said folding means includes a first holding apparatus for disposing said holding means in a first orientation against the leading end of the package being wrapped, and a second folding apparatus for dispensing said holding means in a second orientation against the trailing end of a package being wrapped.

8. The machine of claim 7 wherein said folding means includes a pair of side fold frames and a center fold frame, with said side fold frames being disposed on either side of said conveyor means and said center fold frame being positioned between and above said side fold frames, and further wherein said first folding apparatus comprises one inner fold frame on each of said side and said center fold frames for folding wrapping material against the package leading end and wherein said second folding apparatus includes an outer fold frame on each of said side and said center fold frames for folding wrapping material against the package trailing end.

9. The machine of claim 1 wherein said fastening means includes a stapler head for applying staples to said package through said wrapping material.

10. The machine of claim 9 wherein said stapler head is attached to means for rotating said head into a first orientation for stapling a package leading end, a second orientation for stapling along a package side, and a third orientation for stapling along a package trailing end.

11. The machine of claim 10 wherein said stapler head is slidably mounted on a first beam for movement laterally of said conveyor means.

12. The machine of claim 11 wherein said first beam is slidably mounted on a second beam for movement longitudinally of said conveyor means.

13. The machine of claim 12 wherein said first beam is also pivotally attached to said second beam for allowing said stapler head to be forced against a surface being stapled by pivoting said first beam.

14. The machine of claim 13 wherein said first beam is also slidably mounted on a vertical beam for allowing vertical displacement of said stapler head.

15. A method for wrapping five sides of a six sided package, comprising the steps of:

holding wrapping material in an inverted U configuration in a holding apparatus, said U-configuration having two parallel material portions and a connecting portion;

conveying a package to be wrapped to a first work station beneath the connecting portion and between the parallel portions of the held wrapping material;

moving the holding apparatus with the wrapping material over the package leading end to thereby fold the material over the leading end;

stapling the folded wrapping material to the package leading end;

conveying the package forward, drawing the wrapping material with it until the package trailing end is positioned forward of the initial position of the package leading end;

cutting the wrapping material;

moving the holding apparatus with the wrapping material over the package trailing end to thereby fold the material over the trailing end; and stapling the package trailing end to secure the wrapping material to the package.

16. The method of claim 15 including the step of stapling the wrapping material to the package sides while the package is being conveyed forwardly.

17. The method of claim 16 wherein the step of cutting the wrapping material includes moving a slitter up one side of the wrapping material, across the top of the wrapping material, and down the other side of the wrapping material, and then returning the slitter to its original position.

18. The method of claim 17 wherein the step of stapling the package trailing end is followed by the step of advancing the slit free end of the wrapping material into the holding apparatus in preparation for wrapping of another package.

19. An automatic package wrapping apparatus comprising:

package handling means for horizontally conveying a package from one wrapping station to another;

wrapping material supply means for supplying wrapping material of a predetermined width for wrapping the package;

wrapping material holding means including a center holding means for holding the center of the wrapping material in a horizontal plane above a package to be wrapped, and a pair of side holding means for holding the wrapping material ends in spaced vertical planes;

center folding means connected to said center holding means for moving the center holding means and thereby folding the center portion of said wrapping material selectively against the leading and trailing ends of said package;

said folding means comprising a pair of side folders attached to said side holding means for moving the side holding means and thereby folding the sides of said wrapping material selectively against the leading and trailing ends of said package; and cutting means movable between an inoperative position and an operative position for slitting said wrapping material to provide a length sufficient to wrap said package, fastening means for fastening said wrapping material to said package and thereby drawing said material from the supply means upon the movement of said handling means.

20. The apparatus of claim 19 and further wherein said cutting means includes a cut end holding means for holding said wrapping material while it is being cut and holding the free end of said wrapping material after the cutting thereof.

21. The apparatus of claim 20 and further including translation means for moving said cutting means to a third position for transferring said cut free end from said cut end holding means to said wrapping material holding means.

22. The apparatus of claim 21 wherein said center holding means, said pair of side holding means, and said cut end holding means comprise vacuum tubes having apertures formed therein for communicating a partial vacuum to the wrapping material for holding the wrapping material against the vacuum tubes.

23. The apparatus of claim 19 wherein said center holding means is slidably mounted on said center folding means for longitudinal movement thereon to enable the wrapping material to be drawn tightly on the package being wrapped.

24. The apparatus of claim 23 wherein each of said side holding means is slidably mounted on its respective side folding means for longitudinal movement thereon to enable the wrapping material to be drawn tightly on the package.

* * * * *